US010540905B2

(12) United States Patent
Bohanan et al.

(10) Patent No.: US 10,540,905 B2
(45) Date of Patent: Jan. 21, 2020

(54) SYSTEMS, AIRCRAFTS AND METHODS FOR DRONE DETECTION AND COLLISION AVOIDANCE

(71) Applicant: Gulfstream Aerospace Corporation, Savannah, GA (US)

(72) Inventors: Scott Bohanan, Savannah, GA (US); Fred Taylor, Savannah, GA (US); Jim Jordan, Savannah, GA (US); Matthew Winslow, Savannah, GA (US); Amy Mayo, Savannah, GA (US); John Marchetti, Savannah, GA (US)

(73) Assignee: Gulfstream Aerospace Corporation, Savannah, GA (US)

( * ) Notice: Subject to any disclaimer, the term of this patent is extended or adjusted under 35 U.S.C. 154(b) by 0 days.

(21) Appl. No.: 15/938,244

(22) Filed: Mar. 28, 2018

(65) Prior Publication Data

US 2019/0304316 A1 Oct. 3, 2019

(51) Int. Cl.
*G08G 5/04* (2006.01)

(52) U.S. Cl.
CPC ..... *G08G 5/04* (2013.01)

(58) Field of Classification Search
CPC ..... G08G 5/04
USPC ..... 340/961
See application file for complete search history.

(56) References Cited

U.S. PATENT DOCUMENTS 4,972,503 A * 11/1990 Zurlinden ..... H04H 60/33 725/14
5,017,921 A * 5/1991 McGill ..... G01S 7/023 342/159
7,148,835 B1 * 12/2006 Bricker ..... F41H 11/02 342/20
9,056,676 B1 * 6/2015 Wang ..... B64F 1/00
9,412,278 B1 * 8/2016 Gong ..... H04L 63/101
9,945,931 B2 * 4/2018 Allen ..... G01S 5/12
2003/0090391 A1 * 5/2003 Philiben ..... B64D 47/06 340/945
2005/0017873 A1 * 1/2005 Liu ..... G01M 5/0008 340/870.01
2005/0156777 A1 * 7/2005 King ..... G01S 3/023 342/29
2008/0249669 A1 * 10/2008 Skarman ..... G08G 5/0078 701/3
2009/0027253 A1 * 1/2009 van Tooren ..... G01S 13/9303 342/29
2013/0093625 A1 * 4/2013 Smith ..... G01S 5/0081 342/387

(Continued)

*Primary Examiner* — Kerri L McNally
*Assistant Examiner* — Thang D Tran
(74) *Attorney, Agent, or Firm* — LKGlobal | Lorenz & Kopf, LLP

(57) ABSTRACT

A system and a method for drone detection and collision avoidance, particularly for use in an aircraft, is provided. The system includes, but is not limited to a sensor, a processor, and an avoidance unit comprising a control unit. The sensor is configured to detect a drone signal in a predetermined space and to transmit the drone signal to the processor. The processor is configured to determine the presence of a drone in the predetermined space based on the drone signal. The processor is configured to transmit a command to the avoidance unit when the processor determines the presence of a drone. The control unit is configured to receive the command and to generate a warning signal in response to receiving the command.

20 Claims, 5 Drawing Sheets

(56) References Cited

U.S. PATENT DOCUMENTS

2014/0035783 A1* 2/2014 Contarino ..... G01S 19/21 342/357.59
2014/0204360 A1* 7/2014 Dowski, Jr. ..... G05D 1/101 356/4.01
2014/0233099 A1* 8/2014 Stark ..... G09F 21/06 359/446
2014/0249693 A1* 9/2014 Stark ..... B64C 39/024 701/2
2015/0118983 A1* 4/2015 Malaga ..... H04B 1/1638 455/179.1
2016/0069994 A1* 3/2016 Allen ..... G01S 13/9303 342/29
2016/0203723 A1* 7/2016 Kube ..... G08G 5/045 701/3
2016/0288905 A1* 10/2016 Gong ..... G06F 16/29
2016/0295246 A1* 10/2016 Laksono ..... H04N 21/21805
2016/0358481 A1* 12/2016 Vesely ..... G08G 5/02
2017/0069214 A1* 3/2017 Dupray ..... G08G 5/0021
2017/0092090 A1* 3/2017 Lerner ..... G06K 7/10366
2017/0092138 A1* 3/2017 Trundle ..... B64C 39/024
2017/0234979 A1* 8/2017 Mathews ..... G01S 19/46 342/357.64
2017/0235316 A1* 8/2017 Shattil ..... B64C 39/024 701/3
2017/0317870 A1* 11/2017 Soto ..... H04B 1/7156
2017/0372624 A1* 12/2017 Surcouf ..... H04B 7/0413
2018/0068567 A1* 3/2018 Gong ..... H04W 4/022
2018/0090016 A1* 3/2018 Nishi ..... G08G 5/0039
2018/0095155 A1* 4/2018 Soni ..... G08G 5/0013
2018/0096611 A1* 4/2018 Kikuchi ..... G08G 5/045
2018/0233054 A1* 8/2018 Woon ..... G08G 5/0013
2018/0234203 A1* 8/2018 Hsiao ..... G08B 15/004
2018/0244387 A1* 8/2018 Russell ..... B64C 39/024
2018/0272993 A1* 9/2018 Johnson ..... B60R 25/10

* cited by examiner

SYSTEMS, AIRCRAFTS AND METHODS FOR DRONE DETECTION AND COLLISION AVOIDANCE

TECHNICAL FIELD

Embodiments of the present invention generally relate to detection systems, and more particularly to aircrafts and methods for drone detection and collision avoidance.

BACKGROUND OF THE INVENTION

Drone proliferation is continuously increasing with both hobbyist and commercial models being manufactured. A FAA report from 2016 predicted that seven million drones will be flying over the United States by 2020. Thus, there is need for a system that can sense drones to avoid collisions between drones and aircrafts.

In conventional aircraft, collision warning systems are used that are based on RADAR or transponder technology. These conventional collision warning systems are not able to react to an object such as a drone.

It is desirable to sense drones in close proximity to an aircraft and allow time for a user of the aircraft to maneuver around the drone or to interfere or control the drone to avoid a potential collision with the drone. Furthermore, other desirable features and characteristics of the present invention will become apparent from the subsequent detailed description and the appended claims, taken in conjunction with the accompanying drawings and the foregoing technical field and background.

SUMMARY

The disclosed embodiments relate to a system for drone detection and collision avoidance, particularly for use in an aircraft. In a first non-limiting embodiment, the system includes, but is not limited to a sensor, a processor, and an avoidance unit comprising a control unit. The sensor is configured to detect a drone signal in a predetermined space and to transmit the drone signal to the processor. The processor is configured to determine the presence of a drone in the predetermined space based on the drone signal. The processor is configured to transmit a command to the avoidance unit when the processor determines the presence of a drone. The control unit is configured to receive the command and to generate a warning signal in response to receiving the command.

According to an aspect, disclosed embodiments relate to an aircraft comprising a system. The system includes, but is not limited to a sensor, a processor, and an avoidance unit comprising a control unit. The sensor is configured to detect a drone signal in a predetermined space and to transmit the drone signal to the processor. The processor is configured to determine the presence of a drone in the predetermined space based on the drone signal. The processor is configured to transmit a command to the avoidance unit when the processor determines the presence of a drone. The control unit is configured to receive the command and to generate the warning signal in response to receiving the command.

According to a further aspect, disclosed embodiments relate to a method for drone detection and collision avoidance in an aircraft. The method includes but is not limited to detecting a drone signal in a predetermined space using a sensor. The method further includes, but is not limited to transmitting, by the sensor, the determined drone signal to a processor. The method further includes, but is not limited to determining, by the processor, the presence of a drone in the predetermined space based on the drone signal transmitted by the sensor. The method further includes, but is not limited to transmitting, by the processor, a command to an avoidance unit, when the processor determines the presence of a drone. The method further includes, but is not limited to receiving the command by a control unit of the avoidance unit. And the method further includes, but is not limited to generating, by the control unit, a warning signal in response to receiving the command.

DESCRIPTION OF THE DRAWINGS

Embodiments of the present invention will hereinafter be described in conjunction with the following drawing figures, wherein like numerals denote like elements.

DESCRIPTION OF EXEMPLARY EMBODIMENTS

Figure 1:
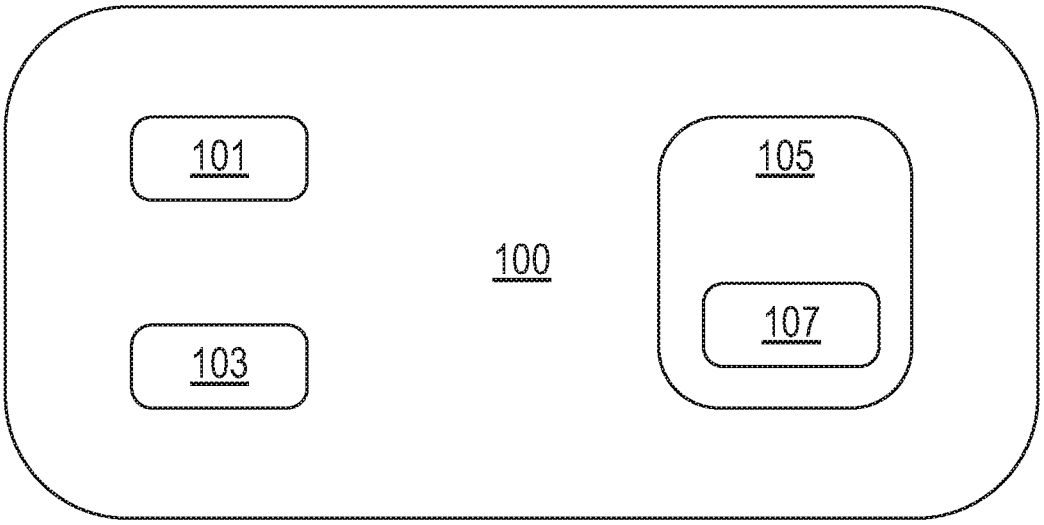
FIG. 1 is a schematic view illustrating a system for drone detection and collision avoidance in accordance with one non-limiting implementation of the disclosed embodiments.

As used herein, the word "exemplary" means "serving as an example, instance, or illustration." The following detailed description is merely exemplary in nature and is not intended to limit the invention or the application and uses of the invention. Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary or the following description.

It is desirable to provide a system for drone detection and collision avoidance in an aircraft such as an airplane, a jet, or a helicopter, for example, that is both easy to control and reliable.

The disclosed embodiments relate to a system for drone detection and collision avoidance. The system can be installed in an aircraft, for example. In one exemplary implementation that will be described below with reference to FIGS. 1-6, the aircraft is an airplane. However, it should be appreciated that the disclosed embodiments can be implemented within any other type of aircraft.

In accordance with the disclosed embodiments, a drone is an unmanned aerial vehicle that is up to 55 pounds in weight.

In an example, a drone is a commercially available remote-controlled model or toy drone. Thus, in accordance with the disclosed embodiments, a drone may be a small or medium, i.e. a group 1 or group 2 drone according to the UAV classification system of the US Department of Defense.

In accordance with the disclosed embodiments, a sensor may be at least one of an antenna, multiple directional antennas, a Millimeter Wave Radar, a LIDAR-sensor, a RADAR-sensor, an Electronically Steered Array weather radar sensor, an infrared (IR) sensor, a video-sensor and/or an audio-sensor.

The sensor may be used by the avoidance unit to emit an avoidance signal that forces a drone to move out of the predetermined space. Thus, the sensor and the avoidance unit may be both part of an integrated device that is configured to receive and to transmit an avoidance signal, such as a control signal for controlling a drone, for example.

Alternatively, the avoidance unit may comprise additional transmission elements to emit an avoidance signal, such as at least one of an antenna, multiple directional antennas, a Millimeter Wave Radar, a LIDAR-device, a RADAR-device, or an Electronically Steered Array weather radar, for example.

The avoidance unit includes a control unit that performs the logic needed of operation of the avoidance unit. The control unit may be any type of conventional processor, controller, microcontroller, field programmable gate array (FPGA), digital signal processor (DSP) or state machine. Thus, the control unit of the avoidance unit may be used to control the sensor of the system to emit an avoidance signal and/or to control an additional transmission element to emit an avoidance signal.

According to an embodiment, the system comprises a processor that is configured to determine the presence of a drone in a predetermined space and to avoid a collision with the drone and aircraft, for example. For this purpose, the processor transmits a command to an avoidance unit, which is configured to generate a warning signal in response to receiving the command. The warning signal may be an acoustic or visual signal that alerts a crew member of the aircraft that a drone has been detected. Thus, the avoidance unit may be configured to output the warning signal on an output unit, such as a display and/or a speaker.

According to an embodiment, the processor may be a processor of a control unit of the avoidance unit.

In an example, the avoidance unit may be emulated by a processor of an aircraft.

In response to a warning signal, a crew member may maneuver the aircraft around the drone. To maneuver the aircraft around the drone, the avoidance unit may calculate an alternate path around the drone.

Alternatively, or additionally the warning signal may include a command to generate an avoidance signal that forces the drone to move out of a predetermined space around the aircraft.

According to an embodiment, the warning signal may be used to alert a crew member in case a drone has been detected in a distance to the aircraft that is greater than a predetermined value. Thus, in case the distance between the drone and the aircraft is greater than the predetermined value, the crew member may react on the warning signals and decide whether to maneuver around the drone or to generate an avoidance signal.

Of course, the crew member may set a command that the warning signal automatically includes a command to generate an avoidance signal even in case the distance between the drone and the aircraft is greater than the predetermined value.

According to another embodiment, the warning signal may include a command to generate an avoidance signal that forces the drone to move out of a predetermined space around the aircraft in case the drone is detected in a distance to the aircraft that is smaller than a predetermined value. In other words, the warning signal may be used to generate an avoidance signal automatically, in case the distance between the drone and the aircraft is smaller than a predetermined value.

According to another embodiment, the warning signal may be used to alert the crew in case an autopilot of the aircraft is deactivated. Thus, in case the autopilot is disabled, the warning signal may be an acoustic or visual signal that alerts a crew member of the aircraft that a drone has been detected.

Of course, the crew member may set a command that the warning signal automatically includes a command to generate an avoidance signal even in case the autopilot is deactivated.

According to another embodiment, the warning signal may automatically include a command to generate an avoidance signal that forces the drone to move out of a predetermined space around the aircraft in case an autopilot of the aircraft is activated.

According to the present disclosure, a warning signal may be a control signal generated by a control unit that may be used to control an output device and/or an avoidance unit.

According to the present disclosure, an avoidance signal may be a signal that forces a drone to move out of a predetermined space. An avoidance signal may be a control signal and/or an interference signal. Thus, the avoidance signal may be used to control a drone by superimposing commands from an operator of the drone, for example. Alternatively, the avoidance signal may be used to "interfere with" a drone, such that control signals of the drone are severed to the drone, which will cause the drone to land, to hover, to return home or descend immediately to the ground. Further, an avoidance signal may be a "GPS spoofing" signal that transmits alternative GPS coordinates to the drone.

A greater understanding of the systems, devices, and methods described above may be obtained through a review of the illustrations accompanying this application together with a review of the detailed description that follows.

FIG. 1 shows a system 100 for drone detection and collision avoidance in accordance with one exemplary, non-limiting implementation. System 100 comprises at least one sensor 101, such as an antenna, and preferably numerous multiple direction antennas. Further, the system comprises a processor 103 and an avoidance unit 105. The processor 103 is used to determine the presence of a drone based on a drone signal determined by the sensor 101. If a drone is detected by the processor 103, the processor transmits a command to a control unit 107 of the avoidance unit 105. The control unit 107 receives the command and, in response, configures the avoidance unit 105 for transmitting a warning signal, such as an optical warning signal and/or a visual warning signal to an output unit to inform a crew member, such as pilot, that a drone has been detected in a predetermined space that is to be monitored by the system.

The sensor 101 may be used for other applications during flight such as weather RADAR. It may never be deactivated. A change in speed and altitude may enable or disable the processor 103 and/or the avoidance unit 105. The drone detection system 100 may be active during take-off and approach.

A drone signal may be any signal, such as a RADAR-response, a datalink frequency, an infrared signature, an audio signal or a combination of several signals that may be used to characterize a drone and to determine the presence of a drone in a predetermined space.

When a warning signal is provided by the avoidance unit, a user or a crew of an aircraft may maneuver around the drone thus preventing a collision. However, if avoidance is not possible due to close drone proximity, for example, the system 100 may use the avoidance unit 105 to generate an avoidance signals that forces the drone to move out of a predetermined space, i.e. to move to a predetermined distance with respect to the aircraft surrounding the system. According to an example, the system 100 may use the avoidance unit 105 to command the drone to "return home" or to "land".

The sensor 101 may be configured to detect the present of a drone by the drone's operating frequency. Thus, the sensor 101 may be configured to detect drone signals from at least one frequency band between 400 MHz and 6 GHz, preferably from at least one frequency band of the following frequency bands: 430 MHz, 915 MHz, 1.2 to 1.4 GHz, and 5.8 GHz.

The sensor 101 may be at least one of an antenna, multiple directional antennas, a Millimeter Wave RADAR, a LIDAR-sensor, a RADAR-sensor, an Electronically Steered Array weather RADAR sensor, an infrared (IR) sensor, a video-sensor or an audio-sensor. Thus, the sensor may be configured to detect the presence of a drone analyzing RADAR returns.

Since most drones are similar in construction, a particular RADAR return which is unique to a drone compared to a bird or other object may be used to validate the present of a drone. Further, RADAR returns may be used to indicate the movement of an object registered by the sensor 101 is similar to a drone compared to a bird or other object.

Further, the processor 103 may be configured to determine datalink control frequencies in the drone signals detected by the sensor 101 in order to determine the presence of a drone in the space to be monitored by the system 100. The space may be predetermined by an engineer or a user of the system 100, such as a pilot, for example.

The processor 103 may execute software or firmware logic used in multiple locations that is configured to determine a location of a drone based on drone signals determined by the sensor 101.

The software logic executed by the processor 103 may also be used to determine whether to output an acoustic or optical warning signal only or to generate an avoidance signal that forces the drone to move out of a predetermined space. To force the drone out of the predetermined space, the drone may be interfered by disrupting and/or severing the drone's operating control frequencies such that the drone is triggered by its own internal software to return to base or descend immediately to the ground, for example.

The processor 103 can be implemented via a microprocessor-based controller. The processor 103 performs the computation and control functions of the system 100. As used herein, a "processor unit" or "processor" can refer to any type of conventional processor, controller, microcontroller, field programmable gate array (FPGA), digital signal processor (DSP) or state machine. A processor can be implemented using a single processor or multiple processors that are not part of a single unit. Further, a processor may comprise single integrated circuits such as a microprocessor, or any suitable number of multiple processors or integrated circuit devices and/or circuit boards working in cooperation to accomplish the functions of a processor. Thus, a processor is not necessarily implemented as a single discrete unit in all embodiments, but may also be implemented using a plurality of said processors that are distributed throughout the node. It should be understood that the processor 103 may comprise a single type of memory component, or it may be linked with a memory composed of many different types of memory components. This memory (not shown) can include non-volatile memory (such as ROM, flash memory, etc.), memory (such as RAM), or some combination of the two. The RAM can be any type of suitable random access memory including the various types of dynamic random access memory (DRAM) such as SDRAM, the various types of static RAM (SRAM). The RAM may include an operating system, and executable code for power control programs and data conversion programs that can be loaded and executed at the processor to convert or translate data received by the processor 103.

The processor 103 may be able to find exactly those frequencies that are used to control the drone and to use these frequencies to control the drone based on these control frequencies.

For finding the control frequencies of the drone, a software logic that analyses the drone signal detected by the sensor 101 may be used.

In order to move the drone out of the space to be monitored by the system 100, the avoidance unit 105 may use an avoidance signal that is based on interference signals, i.e. so called "jamming" of the control frequencies determined by the processor 103 and/or other frequencies. This means that techniques such as: random noise, random pulse, random keyed modulated CW-tones and rotary, pulse, spark, or sweep-through techniques may be applied on the control frequencies determined by the processor 103 and/or multiple other frequencies.

Additionally, or alternatively, interference signals for control frequencies may include a wireless digital modulation scheme, which may be based on a Frequency Hopping Spread Spectrum that uses a predefined frequency channel hopping sequence. In an example, interference techniques include transmitting on all channels within a particular frequency band either individually or simultaneously. An interference technique may include generating broadband noise interference signals or spoofing of actual drone control signals. These control signals may be used to command a drone to "return home" or "land".

Alternatively, an avoidance signal may be based on GPS-spoofing, and alternative control signals.

Preferably, a random noise signal may be generated by the avoidance unit as an avoidance signal based on interference signals for control signals of the drone.

Preferably, the avoidance unit 105 uses a transmitter, such as an antenna, preferably a multi direction antenna to transmit avoidance signals to the drone.

A disruption due to interference signals as described above will force the drone to land. Particularly, the disruption as described above will sever the controls to the drone and will cause the motors and control surfaces to not respond, causing the drone to descend immediately to the ground.

A GPS-spoofing technique will lead the drone away from the aircraft.

Alternative control signals may be used as avoidance signals to maneuver the drone away from the aircraft or around the aircraft on an alternate route.

According to an embodiment, the sensor 101 may be used by the avoidance unit 105 to submit an avoidance signal to the drone. This means that the sensor 101 and the avoidance unit 105 may both be part of an integrated device. Thus, the integrated device may be a transceiver configured to detect, i.e. to receive drone-signals and to transmit an avoidance signal. Alternatively, separate elements may be used as receivers for the sensor 101 and as transmitters for the avoidance unit 105.

Figure 2:
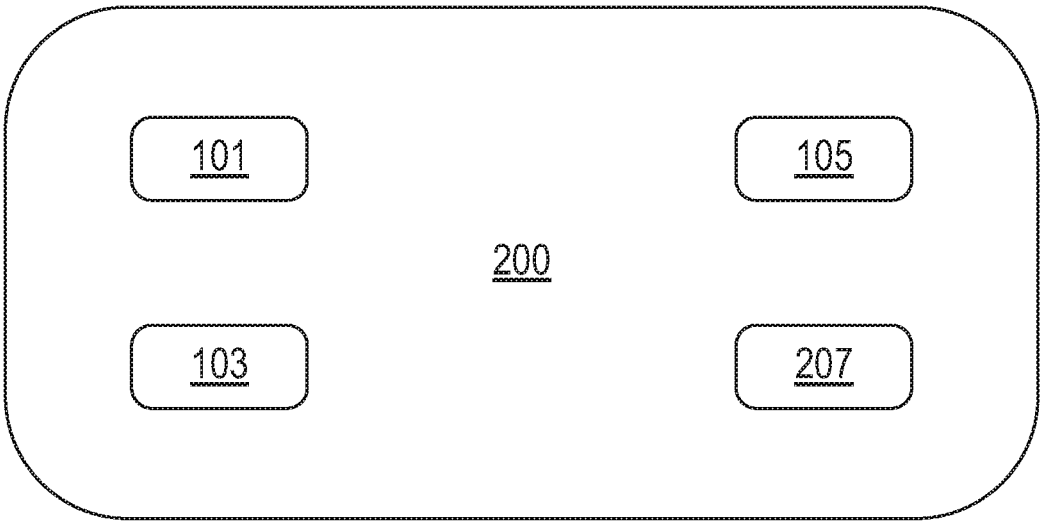
FIG. 2 is a schematic view illustrating a system for drone detection and collision avoidance in accordance with a further non-limiting implementation of the disclosed embodiments.

FIG. 2 shows another system 200 for drone detection and collision avoidance in accordance with one exemplary, non-limiting implementation. The system 200 comprises the sensor 101, the processor 103, the avoidance unit 105 as described with respect to FIG. 1 and a user interface 207.

In response to a warning signal generated by the avoidance unit 105, a user may select from various possibilities provided via the user interface 207 to react on a detection of a drone. The user interface 207 may provide a control element for activating a procedure for flying an aircraft on an alternate path around the drone. Alternatively, or additionally the user interface 207 may provide a control element for transmitting an avoidance signal to the drone that forces the drone to move out of the space that is to be monitored by the system.

The user interface 207 may be a touchpad, a display equipped with control elements, or the like. The user interface 207 may be used as a backup in case automatic generating of an avoidance is not possible or is disabled.

FIGS. 1 and 2 are intended to illustrate a conceptual representation of the system for drone detection and collision avoidance preferably in an aircraft vehicle. It should be appreciated that the sensor 101 the processor 103 and the avoidance unit 105 can be located anywhere onboard the aircraft. Moreover, the number and relative locations of the sensor 101, the processor 103, and the avoidance unit 105 are non-limiting. In other words, any number of sensors 101, processors 103, and avoidance units 105 can be included within the aircraft as shown in FIG. 3, for example.

Other features of the system and the aircraft will now be described below with reference to FIGS. 3 to 5.

Figure 3:
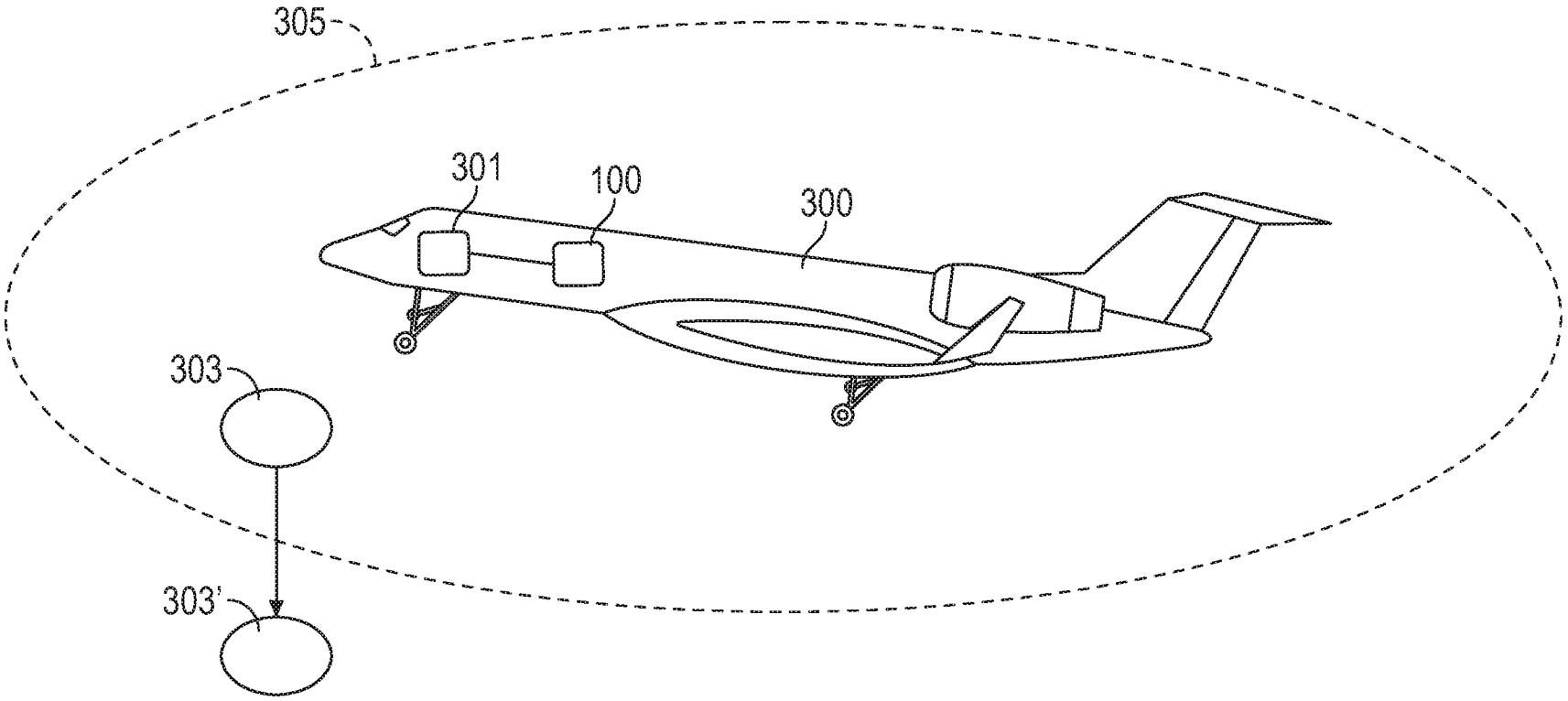
FIG. 3 is a schematic view illustrating an aircraft including a non-limiting embodiment of a system for drone detection and collision avoidance in accordance with one non-limiting implementation of the disclosed embodiments.

In FIG. 3, an aircraft 300 is shown. The aircraft 300 comprises the system 100 as described above with respect to FIG. 1 and a display unit 301.

Further, FIG. 3 shows a predetermined space 305 around the aircraft 300, which is limited by a dashed line. In the predetermined space 305, a drone 303 is shown. Of course, the method described with respect to FIG. 3 may be used for a plurality of drones 303.

When processor 103 of the system 100 of the aircraft 300 determines the presence of the drone 303 in the predetermined space 305, avoidance unit 105 of the system 100 may be configured to transmit an avoidance signal to the drone 303 that forces the drone 303 to move to a position outside the predetermined space 305, as indicated by drone 303'.

In an example, system 100 transmits a warning signal to the display unit 301 that configures the display unit 301 to display information indicative of a warning that the drone 303 has been detected in the predetermined space 305. Further, the avoidance unit 105 may use the display unit 301 to provide a user, such as a pilot, for example, with options to select an avoidance signal used to force the drone 303 out of the predetermined space 305. The avoidance signal to be selected may comprise or may be based on at least one of the following: interference signals for control frequencies, Frequency Hopping Spread Spectrum, Channel interference, broadband noise, GPS-spoofing, and alternative control signals.

According to an embodiment, a predetermined signal type from the list of signal types may be used automatically depending on a current distance between the aircraft and the drone and/or depending an activity of an autopilot of the aircraft and/or depending on a current state of flight of the aircraft. This means that in case the drone 303 is detected in a distance to the aircraft 300 that is smaller than a predetermined distance, the avoidance signal may be generated automatically using a predetermined signal type, such as broadband noise, for example. Alternatively, or additionally, the avoidance signal may be generated automatically in case an autopilot of the aircraft is activated.

In an example, the avoidance signal may be based on a wireless digital modulation scheme, such as a Frequency Hopping Spread Spectrum (FHSS) using a predefined frequency channel hopping sequence, for example. When using a wireless digital modulation scheme, the number of usable channels may be dependent on a frequency band spectrum and/or a drone manufacturer. The drone manufacturer may be determined based on a drone signal detected by the sensor.

In another example, possible interference techniques include transmitting signals on all channels within a predetermined frequency band either individually or simultaneously. An interference technique may include generating noise, such as random noise or spoofing of actual drone control signals. These control signals may be used to command a drone to "return home" or "land" or "move a predetermined distance".

For control frequency interference, interference signals in the frequency range of control signals used to control the drone 303 are generated and used as avoidance signals. The frequency range used to control the drone 303 may be detected by system 100 or may be loaded from a memory. The frequency range used to control drone 303 may cover a frequency band between 400 MHz and 6 GHz. In an example, the frequency range used to control the drone 303 may be slightly above and below at least one of the following frequencies: 430 MHz, 915 MHz, 1.2 to 1.4 GHz, 2.4 GHz, and/or 5.8 GHz. As used in these examples, the term "slightly above and below" is intended to mean approximately 5 MHz, approximately 10 MHz, approximately 50 MHz, approximately 100 MHz, and approximately 200 MHz respectively.

When control interference signals are used as avoidance signals to control the drone 303, these avoidance signals may override a signal used to control the drone 303 by an operator of the drone 303 and, therefore, may force the drone 303 to land or at least to move out of the predetermined space 305.

Newer drones use broadband frequencies to spread spectrum frequency allocation based on frequency hopping spread spectrum techniques, for example. To control drones that use broadband spectrum frequency allocation, broadband noise may interference be used by generating interference signals that are used as avoidance signals in a wide range, such as "white noise", for example. This wide range preferably covers all control frequencies and channels that are to be used to control drones. Thus, the present system may also be used for drones that are operated by using constantly changing control signal frequencies and channels.

For GPS-spoofing, alternative GPS-coordinates and/or GPS-signals may be transmitted to the drone 303 as avoidance signals, which may force the drone 303 to move out of the predetermined space 305.

For generating alternative control signals as avoidance signals, the control signals used to control the drone by an operator of the drone may be detected by the sensor 101 of the system 100, for example. Based on the drone control signals detected by the sensor 101, a frequency range and characteristics of the control signals used by the operator may be decoded. Using the decoded signals, control signals may be generated by system 100 as avoidance signals to control the drone 303 and to override control signals generated by the operator of the drone 303.

According to an embodiment, the processor 103 of the system 100 comprises a plurality of sensors, each sensor 101 of the plurality of sensors comprises a multi-directional antenna, and wherein the processor is configured to determine a region in three-dimensional space where the drone 303 is operating using the plurality of sensors.

By using triangulation, for example, a region where the drone 303 is operating may be calculated. As soon as the region is known, the region may be shown on the display unit 301, so that the pilot can adjust devices, such as antennas used to transmit an avoidance signal to force the drone 303 to move out of the predetermined space 305, to the particular region the drone 303 is operating, for example. The devices may be adjusted automatically depending on a distance between drone 303 and aircraft 300 or an activity of an autopilot or a current state of flight of aircraft 300, for example.

The distance between drone 303 and aircraft 300 may be a current distance measured by a sensor or a distance predicted by a trajectory analysis.

According to another embodiment, the system 100 includes a video-sensor configured to capture video data and a display unit. The processor is operatively coupled with the video-sensor and configured to orient the video-sensor to capture the video data from a region where the drone is operating. The processor is further operatively coupled with the display unit and further configured to control the display unit to display the video data. According to an example, the video-sensor used to capture the video data may be infrared-based. An infrared sensor may be used to detect a drone based on its heat signature.

According to another embodiment, the processor 103 of the system 100 is configured to control a video-sensor to capture video information in the region where the drone is operating and to display the video information and/or information from the region on the display unit 301. In an example, the region may be a quadrant.

In order to generate a signal indicative of a region the drone 303 is operating in, any sensor, such as an antenna, multiple directional antennas, a Millimeter Wave RADAR, a LIDAR, a RADAR, an Electronically Steered Array weather RADAR, a video-sensor, an infrared sensor, and/or an audio-sensor may be used.

Figure 4:
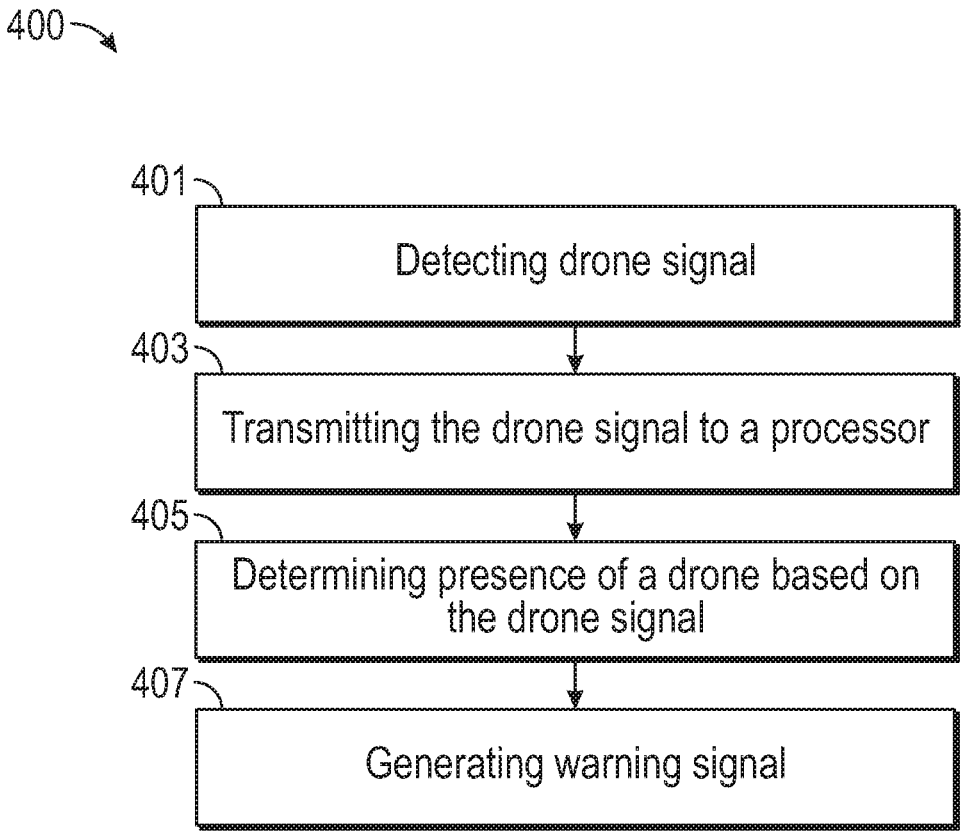
FIG. 4 is a flow chart illustrating an exemplary method for drone detection and collision avoidance in accordance with one non-limiting implementation of the disclosed embodiments.

FIG. 4 is a diagram that illustrates different aspects of a method 400 for drone detection and collision avoidance according to an embodiment. The method starts with a detection step 401, for detecting a drone signal in a predetermined space by a sensor, such as sensor 101 as described with respect to FIG. 1. In detection step 401, the sensor may be used for but is not limited to detection of a drone signal in a predetermined frequency range, such as a range of frequencies that are used to control a drone. Additionally, or alternatively, the sensor may be used for detection of a drone signal generated by a drone in operation, such as noise generated by a propeller or an electric engine used for operating a drone. Additionally, or alternatively, signals detected by other sensors, such as an antenna, multiple directional antennas, a Millimeter Wave RADAR, a LIDAR, a RADAR, an Electronically Steered Array weather RADAR, a video-sensor, an infrared sensor, and/or an audio-sensor may be used for detecting the drone.

The drone signal detected by the sensor in detection step 401 is transmitted to a processor in a transmission step 403. The drone signal detected by the sensor in detection step 401 may be transmitted to the processor continuously by using a data stream, for example. Alternatively, the drone signal detected by the sensor in detection step 401 may be transmitted to the processor step-by-step, by using data packages, for example. In an example, an infrared sensor may be used for an optical detection of the drone.

Based on the drone signal transmitted in transmission step 403, the processor determines the presence of a drone in a predetermined space in determination step 405. The processor may use artificial intelligence to detect the presence of a drone, i.e. to classify the signals transmitted in transmission step 403 in being drone-related or not being drone-related. Alternatively, or additionally, the processor may match the drone signal transmitted in transmission step 403 with a set of predetermined signals that are indicative of a drone operation.

When the determination procedure is indicative of the presence of a drone in the predetermined space, the processor generates a command and transmits the command to a control unit of the avoidance unit. The control unit receives the command and becomes configured depending on the command. When the determination procedure is not indicative of a drone operating in the predetermined space, no command is transmitted to the control unit. Alternatively, a standby signal indicative of a drone-free predetermined space that is presented on a display unit and/or via a speaker is transmitted to an output unit in case the determination procedure is not indicative of a drone operating in the predetermined space.

In output step 407, the avoidance unit, such as avoidance unit 105 described with respect to FIG. 1, is used to generate a warning signal. The warning signal may be indicative of an outcome of the determination procedure in determination step 405 that is performed on data transmitted in transmission step 403. The warning signal may be transmitted to an output unit, such as the output unit 301 described with respect to FIG. 3. The output unit may be a standby display, a flight guidance panel, or other displays located in a cockpit.

The warning signal may be one or a combination of: annunciator tone and/or light, CAS message. The warning signal may provide additional information showing a position of the drone relative to a position of the aircraft and/or an avoidance vector i.e. an alternative flight path.

Figure 5:
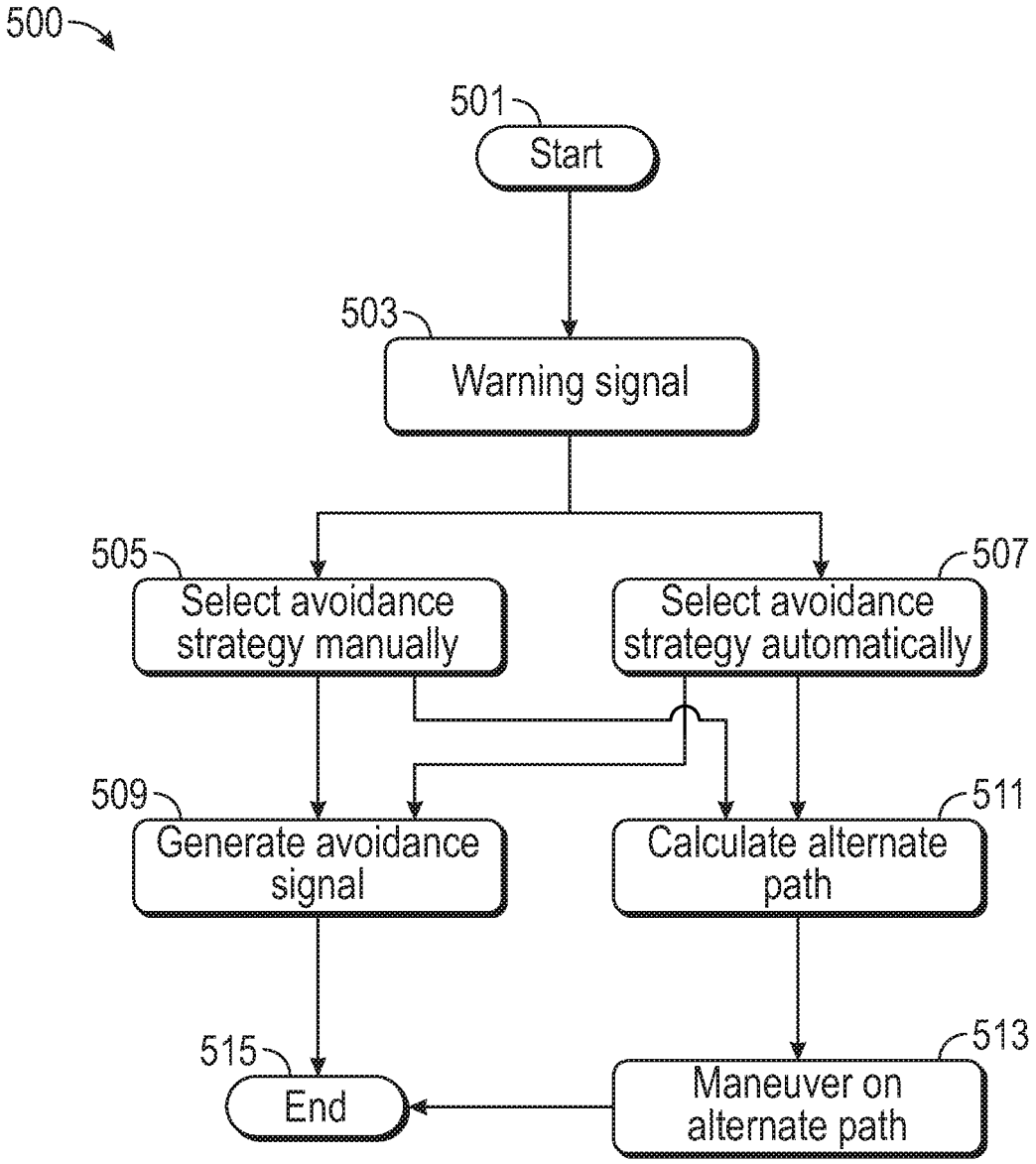
FIG. 5 is a flow chart illustrating an exemplary method for drone detection and collision avoidance in accordance with a further non-limiting implementation of the disclosed embodiments.

FIG. 5 is a diagram that illustrates different aspects of a method 500 when the determination procedure in determination step 405 of method 400 as shown with respect to FIG. 4 is indicative of a drone operating in the predetermined space.

When the presence of a drone is determined in the predetermined space, a processor that determined the presence of the drone transmits a command to a control unit of an avoidance unit, such as the avoidance unit 105 described with respect to FIGS. 1 to 3. The command may start method 500 as shown in FIG. 5 in activation step 501.

The command may configure the avoidance unit to display a warning signal on a display in warning step 503. The warning signal may comprise a message that an avoidance signal will be generated automatically or that a manual selection of an avoidance strategy is needed.

In case a manual selection of an avoidance strategy is needed, the avoidance unit provides a crew member with a list of avoidance strategies to be selected in a manual selection step 505 using an interface, for example. Thus, in manual selection step 505 the crew member may select from various strategies such as generating an avoidance signal selected from a list of avoidance signals to be generated in generation step 509 and/or calculating an alternate route around the drone in calculation step 511.

The alternate route calculated in calculation step 511 may be displayed on a display and used by a pilot to maneuver around the drone manually.

A manual selection of an avoidance strategy may be carried out only in case an autopilot of the aircraft is deactivated and/or a distance between the drone and the aircraft is greater than a predetermined threshold, for example. Further, the manual selection step 505 may be used as a backup, i.e. in case an automatic selection of an avoidance signal is not possible or not wanted.

Alternatively, the avoidance strategy may be selected automatically by the avoidance unit in automatic selection step 507. This means that the avoidance unit may select an avoidance signal to be generated in generation step 509, based on a predetermined setting stored in a memory unit of the avoidance unit, for example.

Additionally, or alternatively, in maneuver step 513, the avoidance unit may automatically maneuver the aircraft around the drone on the alternate route calculated in calculation step 511. An automatic selection of an avoidance strategy may be carried out in case an autopilot of the aircraft is activated or a distance between the drone and the aircraft is smaller than a predetermined threshold, for example.

In an example, a particular avoidance strategy from various avoidance strategies, such as generating an avoidance signal in generation step 509 or maneuver around the drone on an alternate path calculated in calculation step 511 may be selected automatically, by the avoidance unit, based on at least one of the following: a distance between the drone and the aircraft, a predictive trajectory of the drone and/or the aircraft, a control surface response time, a flight phase of the aircraft, and an activity of an autopilot of the aircraft.

According to an embodiment, an avoidance signal generated in generation step 509 may be based on datalink control frequencies used to control the drone. Thus, datalink control frequencies that are known as frequencies for controlling the drone may be duplicated or may be used to identify a set of control signals that may be used to control the drone and to switch the drone in an emergency mode, for example.

According to another embodiment, a particular avoidance signal to be generated in generation step 509 may be selected automatically from a list of avoidance signals, by the avoidance unit, based on at least one of the following: a distance between the drone and the aircraft, a predictive trajectory of the drone and/or the aircraft, a control surface response time, a flight phase of the aircraft, an activity of an autopilot of the aircraft.

The automatic selection of the avoidance strategy may only be activated when the aircraft is not in cruise mode. Thus, the automatic selection of the avoidance strategy may only be activated when the aircraft is in approach or take-off mode. This means, at least one of the sensor, the processor, and the avoidance unit is deactivated when the aircraft is operated in cruise mode.

According to an embodiment, datalink control frequencies for generating an avoidance signal in generation step 509 may be determined based on a drone signal determined by a sensor of the avoidance unit and/or a sensor of the aircraft. The sensor used to determine the datalink control frequencies may be an antenna, such as a multi-array antenna, for example.

The method terminates at termination step 511.

Figure 6:
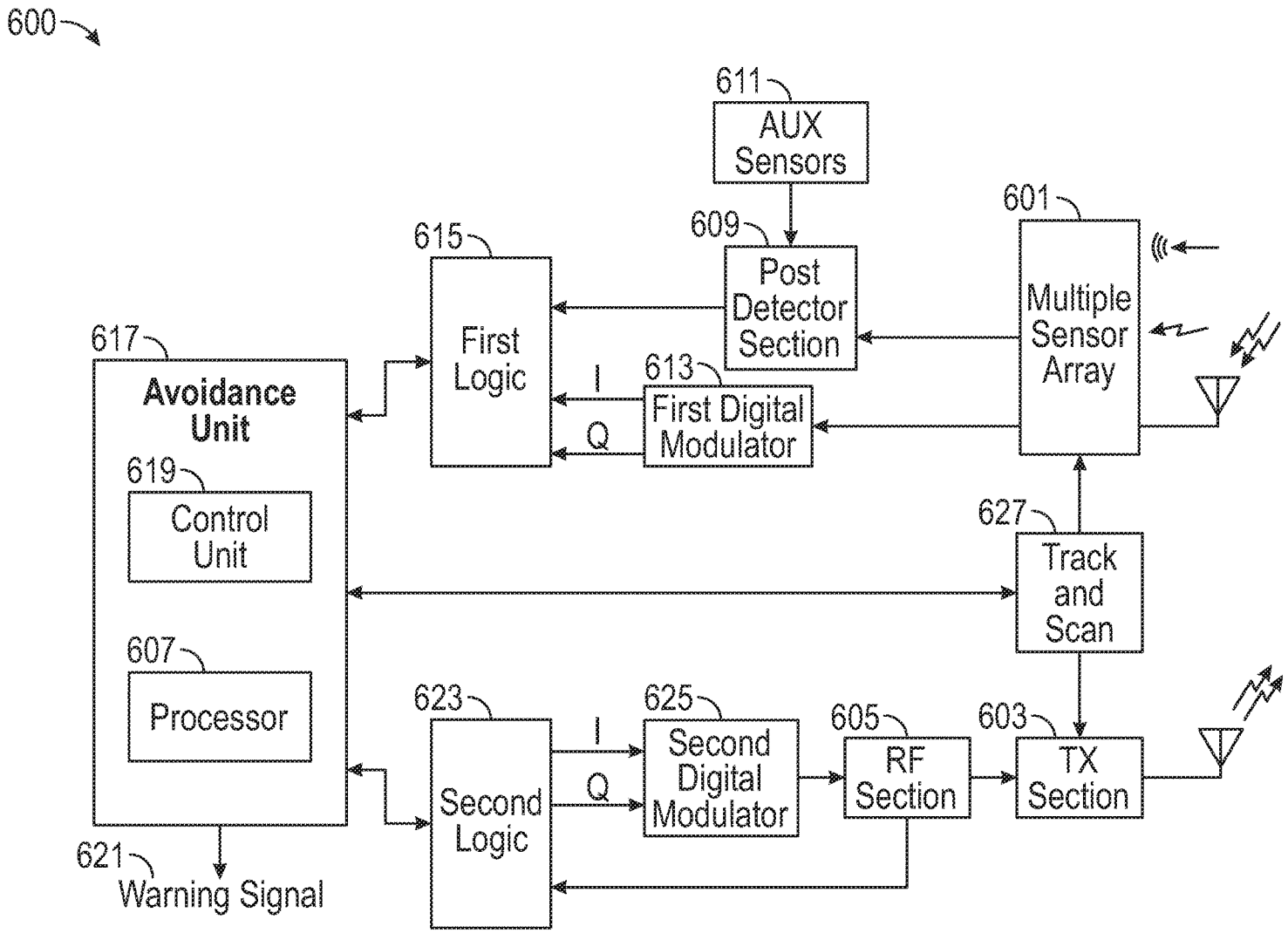
FIG. 6 is an overview of a system for drone detection and collision avoidance in accordance with one non-limiting implementation of the disclosed embodiments.

FIG. 6 is an overview of a system 600 for drone detection and collision avoidance according to an embodiment.

System 600 comprises a sensor 601, which may be a multiple sensor array for detecting RADAR signals, a transmitter 603 connected to a radio frequency module 605, and a processor 607.

The sensor 601 is connected to a post detector section 609 that receives input from an AUX-sensor 611 for detecting sounds, for example. The post detector section 609 may be used to apply filters to a signal detected by the sensor 601 and/or the AUX-sensor 611, for example.

Signals detected by the sensor 601 are transmitted to a digital demodulator 613 and then transmitted, as "I" and "Q" data, for example, to a first logic module 615. Signals adapted by the post detector section 609 are directly transmitted to the first logic module 615.

Processor 607 analyses the signals transmitted to the first logic module 615 to determine the presence of a drone i.e. the presence of a drone signal in the signals detected by sensor 601 and/or AUX-sensor 611. The presence of a drone may be determined based on known patterns of signals generated by drones. These known patterns may be stored in a memory unit (not shown).

In case processor 607 determines the presence of a drone, processor 607 transmits a command to a control unit 619 of an avoidance unit 617 that configures avoidance unit 617 to generate a warning signal 621. The warning signal 621 may be transmitted to a display unit of an aircraft comprising system 600.

The warning signal 621 generated by avoidance unit 617 may also comprise a command that configures avoidance unit 617 to generate an avoidance signal.

To transmit the avoidance signal to the drone, the avoidance unit 617 transmits a command to a second logic module 623, which computes parameters of the avoidance signal, such as coordinates of the drone or a modulation of the avoidance signal.

The second logic module 623 may use a known command set stored in the memory unit (not shown) to generate an avoidance signal that controls the drone by overwriting commands transmitted by an operator of the drone.

The parameters computed by the second logic module 631 are transmitted to a digital modulator 625 as "I" and "Q" data, for example, and to the radio frequency module 605, which provides a feedback for the second logic module 623. The radio frequency module 605 transmits the avoidance signal to the transmitter 603, which transmits the avoidance signal to the drone in order to force the drone to move out of a predetermined space around the aircraft.

A track and scan module 627 may be used to monitor the sensor 601 and the transmitter 603 by the processor 607.

Those of skill in the art would further appreciate that the various illustrative logical blocks, modules, circuits, described in connection with the embodiments disclosed herein may be implemented as electronic hardware, computer software, or combinations of both. Some of the embodiments and implementations are described above in terms of functional and/or logical block components (or modules). However, it should be appreciated that such block components (or modules) may be realized by any number of hardware, software, and/or firmware components configured to perform the specified functions. To clearly illustrate this interchangeability of hardware and software, various illustrative components, blocks, modules, circuits, have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The embodiments disclosed herein may be embodied directly in hardware, in a software module executed by a processor, or in a combination of the two. A software module may reside in RAM memory, flash memory, USB flash memory stick, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description, it should be appreciated that a vast number of variations exist. For example, although the disclosed embodiments are described with reference to a flight control computer of an aircraft, those skilled in the art will appreciate that the disclosed embodiments could be implemented in other types of computers that are used in other types of aircrafts. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A system for drone detection and collision avoidance, the system comprising:

a sensor;

a processor; and an avoidance unit comprising a control unit, wherein the sensor is configured to detect a drone signal in a predetermined space and to transmit the drone signal to the processor, wherein the processor is configured to determine the presence of a drone in the predetermined space based on the drone signal, wherein the drone is separate from the system, wherein the processor is configured to transmit a command to the avoidance unit when the processor determines the presence of a drone, wherein the control unit is configured to receive the command and to generate a warning signal in response to receiving the command, and wherein the avoidance unit is configured to transmit an avoidance signal to the drone in response to the control unit receiving the command, wherein the avoidance signal is configured to interact with the drone and is at least one of a control signal, an interference signal, and a location spoofing signal, and wherein the control signal uses control frequencies identified by intercepting drone control signals sent by an operator of the drone and by decoding the drone control signals to find the control frequencies used to control the drone.

2. The system according to claim 1, wherein the avoidance signal is configured to force the drone to move out of the predetermined space.

3. The system according to claim 2, wherein the system further comprises a user interface, configured to permit a user to select at least one of a control signal, an interference signal, and a location spoofing signal as the avoidance signal.

4. The system according to claim 3, wherein the at least one of the control signal, the interference signal, and the location spoofing signal is configured for at least one of the following: control frequency interference, broadband noise interference, GPS-spoofing, a wireless digital modulation scheme, and Channel interference.

5. The system according to claim 1, wherein the sensor comprises at least one of an antenna, a multidirectional antenna, a Millimeter Wave RADAR, a LIDAR, a RADAR, an infrared sensor, an Electronically Steered Array weather RADAR, a video-sensor, and an audio-sensor.

6. The system according to claim 1, wherein the sensor is configured to detect signals from at least one frequency band between 400 MHz and 6 GHz.

7. The system according to claim 1, wherein the processor is configured to detect a datalink control frequency in the signal detected by the sensor in order to determine the presence of a drone in the predetermined space.

8. The system according to claim 1, further comprising a plurality of sensors, wherein each sensor of the plurality of sensors comprises a multi-directional antenna, and wherein the processor is configured to determine a region in three-dimensional space where the drone is operating using the plurality of sensors.

9. The system according to claim 8, wherein the system includes a video-sensor configured to capture video data and a display unit, wherein the processor is operatively coupled with the video-sensor and configured to orient the video-sensor to capture the video data from a region where the drone is operating, and wherein the processor is further operatively coupled with the display unit and further configured to control the display unit to display the video data.

10. The system according to claim 9, wherein the processor is configured to control the display unit to display signals indicating a direction of signals produced by the avoidance unit in order to force the drone to move out of the predetermined space.

11. An aircraft comprising:

a system for drone detection and collision avoidance, the system including:

a sensor;

a processor; and an avoidance unit comprising a control unit, wherein the sensor is configured to detect a drone signal in a predetermined space and to transmit the drone signal to the processor, wherein the processor is configured to determine the presence of a drone in the predetermined space based on the drone signal, wherein the drone is not the aircraft, wherein the processor is configured to transmit a command to the avoidance unit when the processor determines the presence of a drone, wherein control unit is configured to receive the command and to generate a warning signal in response to receiving the command, and wherein the avoidance unit is configured to transmit an avoidance signal in response to the control unit receiving the command, wherein the avoidance signal is configured to interact with the drone and is at least one of a control signal, an interference signal, and a location spoofing signal, and wherein the control signal uses control frequencies identified by intercepting drone control signals sent by an operator of the drone and by decoding the drone control signals to find the control frequencies used to control the drone.

12. The aircraft according to claim 11, wherein the avoidance unit is configured to transmit the avoidance signal to the drone automatically in response to receiving the command depending on at least one of the following criteria: a current distance between the aircraft and the drone, an activity of an autopilot of the aircraft, and a current phase of flight of the aircraft.

13. The aircraft according to claim 12, wherein the processor is configured to calculate an alternate flight path that avoids a collision with the drone, when the processor detects the drone in the predetermined space, and wherein the avoidance unit is configured to transmit a signal to the drone that forces the drone to move out of the predetermined space when the alternate flight path is not possible.

14. The aircraft according to claim 13, wherein, when the alternate flight path is possible, the processor is configured to provide a pilot of the aircraft with the alternate flight path.

15. The aircraft according to claim 13, wherein, when the alternate flight path is possible, the processor is configured to automatically maneuver the aircraft on the alternate flight path.

16. The aircraft according to claim 15, wherein at least one of the sensor, the processor, and the avoidance unit is deactivated when the aircraft is operated in cruise mode.

17. A method for drone detection and collision avoidance in an aircraft, the method comprising the following steps:

detecting a drone signal in a predetermined space using a sensor;

transmitting, by the sensor, the drone signal to a processor, determining, by the processor, the presence of a drone that is not the aircraft in the predetermined space based on the drone signal transmitted by the sensor;

transmitting, by the processor, a command to an avoidance unit when the processor determines the presence of a drone;

receiving the command by a control unit of the avoidance unit;

generating, by the control unit, a warning signal in response to receiving the command, and transmitting to the drone, by the avoidance unit in response to the control unit receiving the command, an avoidance signal configured to interact with the drone that is at least one of a control signal, an interference signal, and a location spoofing signal, wherein the control signal uses control frequencies identified by intercepting drone control signals sent by an operator of the drone and by decoding the drone control signals to find the control frequencies used to control the drone.

18. The method according to claim 17, wherein the method further comprises:

calculating, by the processor, an alternate flight path to avoid a collision with the drone; and transmitting, by the avoidance unit, a signal to the drone that forces the drone to move out of the predetermined space, if the alternate flight path is not possible.

19. The method according to claim 18, wherein the method further comprises:

providing a user with a possibility to select the at least one of the control signal, the interference signal, and the location spoofing signal that is to be used by the avoidance unit to force the drone to move out of the predetermined space on a user interface.

20. The method according to claim 17, wherein the method further comprises determining, by the processor, a presence of a datalink control frequency in the signal detected by the sensor and determining the presence of a drone in the predetermined space based on the presence of the datalink control frequency.

* * * * *